US007972574B2

(12) United States Patent
Addicks et al.

(10) Patent No.: US 7,972,574 B2
(45) Date of Patent: Jul. 5, 2011

(54) PRODUCTION WASTE TEST KIT

(75) Inventors: Glynda A. Addicks, Sugar Land, TX (US); Bharat Arora, Halifax, CA (US); Mukesh Kapila, The Woodlands, TX (US)

(73) Assignees: M-I L.L.C., Houston, TX (US); M-I Drilling Fluids Canada, Inc., Calgary, Alberta (CA)

( * ) Notice: Subject to any disclaimer, the term of this patent is extended or adjusted under 35 U.S.C. 154(b) by 334 days.

(21) Appl. No.: 12/325,760

(22) Filed: Dec. 1, 2008

(65) Prior Publication Data

US 2009/0142228 A1 Jun. 4, 2009

Related U.S. Application Data

(60) Provisional application No. 60/992,008, filed on Dec. 3, 2007.

(51) Int. Cl.
*B01L 3/00* (2006.01)

(52) U.S. Cl. ..... 422/430; 422/500; 206/45.24; 206/223; 206/305; 206/569

(58) Field of Classification Search ..... 422/430, 422/500; 206/45.24, 223, 305, 569
See application file for complete search history.

(56) References Cited

U.S. PATENT DOCUMENTS

| | | | | | |
|---|---|---|---|---|---|
| 1,910,236 | A * | 5/1933 | Butler | 422/430 |
| 2,390,236 | A * | 12/1945 | Boothby et al. | 128/205.12 |
| 3,127,986 | A * | 4/1964 | Hulka | 206/223 |
| 3,203,540 | A * | 8/1965 | Kalt et al. | 206/569 |
| 3,743,088 | A * | 7/1973 | Henkin | 206/569 |
| 4,067,776 | A * | 1/1978 | Khan | 435/34 |
| 4,195,059 | A * | 3/1980 | Whitcher et al. | 422/401 |
| 4,303,610 | A * | 12/1981 | Sardisco et al. | 422/430 |
| 4,333,908 | A * | 6/1982 | Maki et al. | 422/430 |
| 5,100,621 | A * | 3/1992 | Berke et al. | 422/430 |
| 5,268,148 | A * | 12/1993 | Seymour | 422/419 |
| 5,353,803 | A * | 10/1994 | Cerra | 600/562 |
| 5,523,055 | A * | 6/1996 | Hansen et al. | 422/401 |
| 5,624,638 | A * | 4/1997 | Negrotti | 422/430 |
| 6,283,566 | B1 * | 9/2001 | Doces | 312/351 |
| 6,598,464 | B1 * | 7/2003 | Rossi | 73/53.05 |
| 6,929,778 | B2 * | 8/2005 | Nunes et al. | 422/430 |
| 7,497,328 | B2 * | 3/2009 | Tonelli | 206/305 |
| 2002/0150504 | A1 * | 10/2002 | Nunes et al. | 422/61 |
| 2005/0112775 | A1 * | 5/2005 | Forsythe et al. | 436/178 |
| 2006/0286606 | A1 * | 12/2006 | Oliver | 435/7.1 |
| 2007/0041871 | A1 * | 2/2007 | Lecrone | 422/61 |

* cited by examiner

*Primary Examiner* — N Suk Bullock
*Assistant Examiner* — Dennis M White
(74) *Attorney, Agent, or Firm* — M-I L.L.C.

(57) ABSTRACT

A test kit for testing production waste includes a plurality of components including reagents, test equipment, or a combination thereof, sufficient to perform analysis on production waste and at least one protective case for shipping and for using the plurality of components, the protective case including a top portion releasably engaged with a bottom portion. The top portion includes a top side attached at an inner face of the top side to a top edge of a continuous sidewall formed by a plurality of sides such that the top portion of the protective case includes a hollow interior cavity bound by the inner face of the top side and an inner face of the continuous sidewall, wherein the hollow interior cavity is open on a bottom side, and wherein the hollow interior cavity defines a water-tight enclosure opened on the bottom side, such that the top portion, resting on a support surface inverted on an outer face of the top side, is capable of forming a liquid reservoir.

18 Claims, 9 Drawing Sheets

PRODUCTION WASTE TEST KIT

CROSS-REFERENCE TO RELATED APPLICATIONS

This application, pursuant to 35 U.S.C. §119(e), claims priority to U.S. Provisional Application Ser. No. 60/992,008 filed Dec. 3, 2008. That application is incorporated by reference in its entirety.

BACKGROUND OF INVENTION

1. Field of the Invention

This invention relates to a kit for testing demulsification of production waste or oil/water/solids emulsions. In particular, a portable kit for on-site testing of production waste generated during refinery operations, as production by-products, emulsions, slop oils, slurries and tank bottoms which accumulate in process vessels and tanks.

2. Background Art

Production waste in generated in refineries and processing facilities and constitute production by-products, emulsions, slop oils, slurries and tank bottoms which accumulate in process vessels and tanks. This production waste is typically strong oil and water emulsions, chemically bound by naturally occurring soaps and various mixtures of stabilizing fine sand, scale, and wax. These wastes often form stable emulsions with rainwater or produced water and also contain waxy components which further stabilize the emulsion. Often these wastes are allowed to stand in open outdoor pits for multiple years. During this time, light-end hydrocarbons are volatilized and released from the mixture, leaving behind heavy nonvolatile species which encapsulate entrained water and solids, enhancing the stability of the emulsion. This production waste is often referred to as exploration and production wastes, and may be abbreviated simply as E&P waste.

E&P waste may be land filled, incinerated, and/or re-injected back into an existing well once the waste is made suitable for re-injection. However, in view of environmental concerns and the value of the petroleum present in the E&P waste, efforts may be made to reclaim at least a portion of the petroleum in the waste. This reclamation process may include characterization and testing of the waste to determine the optimal strategy for reclamation. However, in view of the remote locations such waste may exist at, sampling and testing/characterization of the waste may result in long delay times, expense, and depending on the waste composition, erroneous results. It is advantageous to test E&P wastes on-site, where the waste is abundant and testing can be conducted in an economically viable period of time. In addition, during treatment of the waste, process optimization is essential and can be tested on-site in small scale.

Testing of E&P waste requires specialized equipment, which includes laboratory glassware and other scientific components which are not amenable to being shipped to remote locations. On-site production waste testing presents formidable challenges in terms of logistics and complexity. Accordingly, a need exists to enable on-site production waste testing, especially in remote locations.

SUMMARY OF INVENTION

In a first aspect of the present invention, a test kit for testing production waste comprises:

a plurality of components comprising reagents, test equipment, or a combination thereof, sufficient to perform analysis on production waste; and at least one protective case for shipping and for using the plurality of components, the protective case comprising a top portion releasably engaged with a bottom portion;

the top portion comprising a plurality of sides continuously disposed about a central axis to form a continuous sidewall; the continuous sidewall having a top edge and a bottom edge separated by a sidewall height;

the top portion further comprising a top side attached at an inner face of the top side to the top edge of the continuous sidewall such that the top portion of the protective case comprises a hollow interior cavity bound by the inner face of the top side and an inner face of the continuous sidewall, wherein the hollow interior cavity is open on a bottom side, and wherein the hollow interior cavity is adapted to receive protectively the plurality of components;

the bottom portion of the protective case comprising a bottom plate dimensioned and arranged to engage at least a portion of the continuous sidewall such that when the top portion is engaged with the bottom portion, the interior cavity is bound on all sides by the inner face of the top side, the inner face of the continuous sidewall, and an inner face of the bottom plate;

wherein the hollow interior cavity of the top portion defines a water-tight enclosure opened on the bottom side, such that the top portion, resting on a support surface inverted on an outer face of the top side, is capable of forming a liquid reservoir.

These and other features, aspects and advantages of the present invention will become better understood with reference to the following drawings, description and claims.

DETAILED DESCRIPTION

Figure 1:
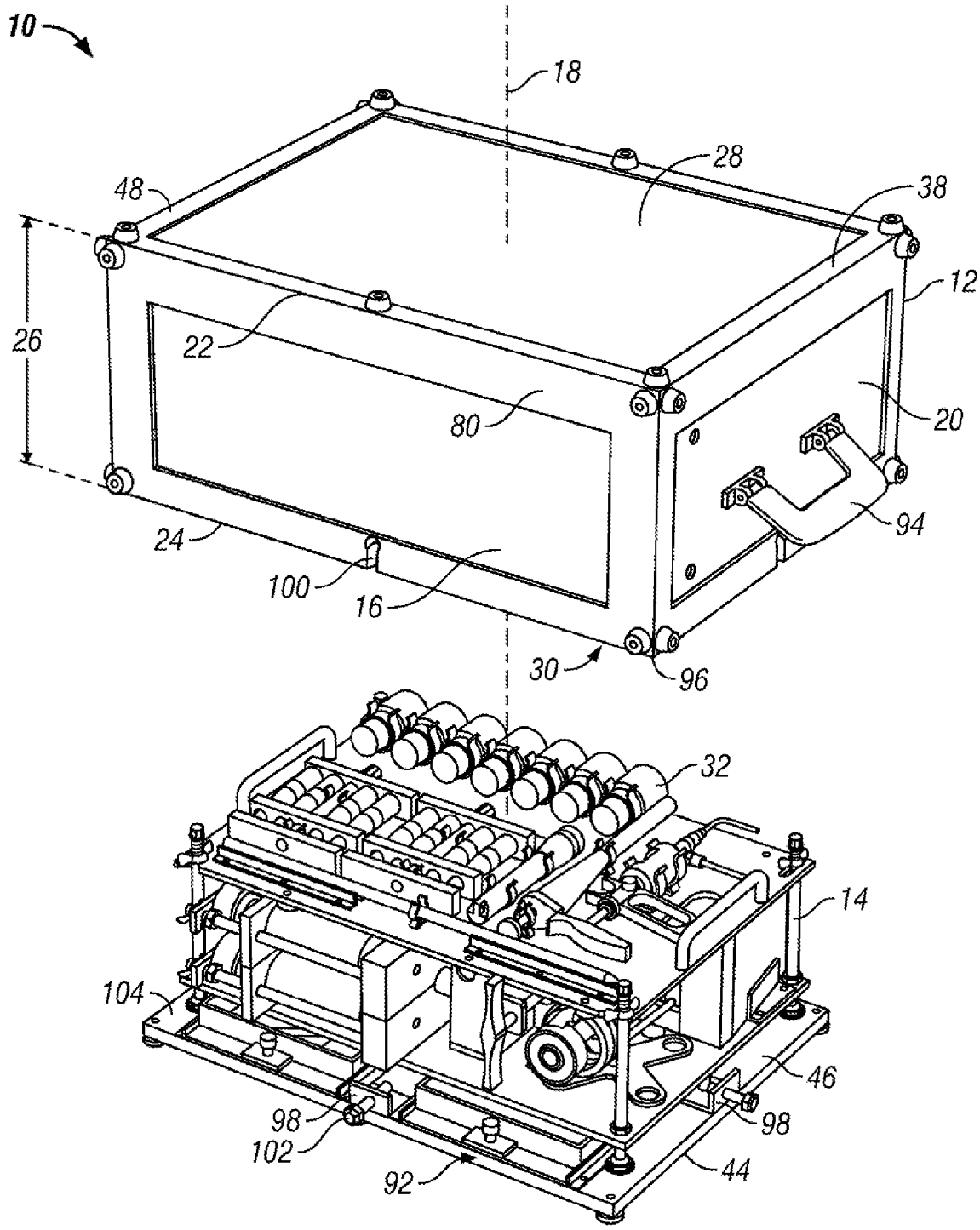
FIG. 1 is an exploded view of a test kit of the instant disclosure.

The following detailed description is of the best currently contemplated modes of carrying out the invention. The description is not to be taken in a limiting sense, but is made merely for the purpose of illustrating the general principles of the invention, since the scope of the invention is best defined by the appended claims.

In the following description, numerous specific details are set forth to provide a thorough understanding of the present invention. However, it will be obvious to those skilled in the art that the present invention may be practiced without such specific details. In other instances, well-known devices have been shown in block diagram form in order not to obscure the present invention in unnecessary detail. For the most part, details unnecessary to obtain a complete understanding of the present invention have been omitted in as much as such details are within the skills of persons of ordinary skill in the relevant art.

Broadly, the present invention generally provides a test kit for testing production waste or oil/water/solids emulsions. In an embodiment, the instant disclosure provides for a portable test kit for testing production waste, with a portable test kit for testing E&P production waste being more preferred. In an embodiment, the test kit of the instant disclosure includes a plurality of components comprising reagents, test equipment, and/or the like sufficient to perform analysis on production waste. These components are located in at least one protective case for shipping and for using the components. The protective case comprises a top portion that is releasably engaged with a bottom portion.

In an embodiment, the top portion of the protective case comprises a plurality of sides continuously disposed about a central axis to form a continuous sidewall; the continuous sidewall having a top edge and a bottom edge separated by a sidewall height;

the top portion further comprising a top side attached at an inner face of the top side to the top edge of the continuous sidewall such that the top portion of the protective case comprises a hollow interior cavity bound by the inner face of the top side and an inner face of the continuous sidewall, wherein the hollow interior cavity is open on a bottom side, and wherein the hollow interior cavity is adapted to receive protectively the plurality of components.

Refer now to the drawings wherein depicted elements are not necessarily shown to scale and wherein like or similar elements are designated by the same reference numeral through the several views.

FIG. 1 shows an exploded view of an embodiment of the test kit, generally referred to as 10, wherein a protective case comprises a top portion 12 releasably engagable with a bottom portion 14. In the embodiment shown in FIG. 1, top portion 12 is removed from the bottom portion 14. Top portion 12 comprises a plurality of sides 16 disposed about a central axis 18 to form a continuous sidewall 20. Continuous sidewall 20 includes a top edge 22 separated from a bottom edge 24 by a sidewall height 26. Top portion 12 further includes a top side 28, attached to top edge 22 such that a hollow interior cavity 30 (see FIG. 2) is formed within top portion 12. Hollow interior cavity 30 is dimensioned and arranged to receive protectively the plurality of components 32.

Figure 2:
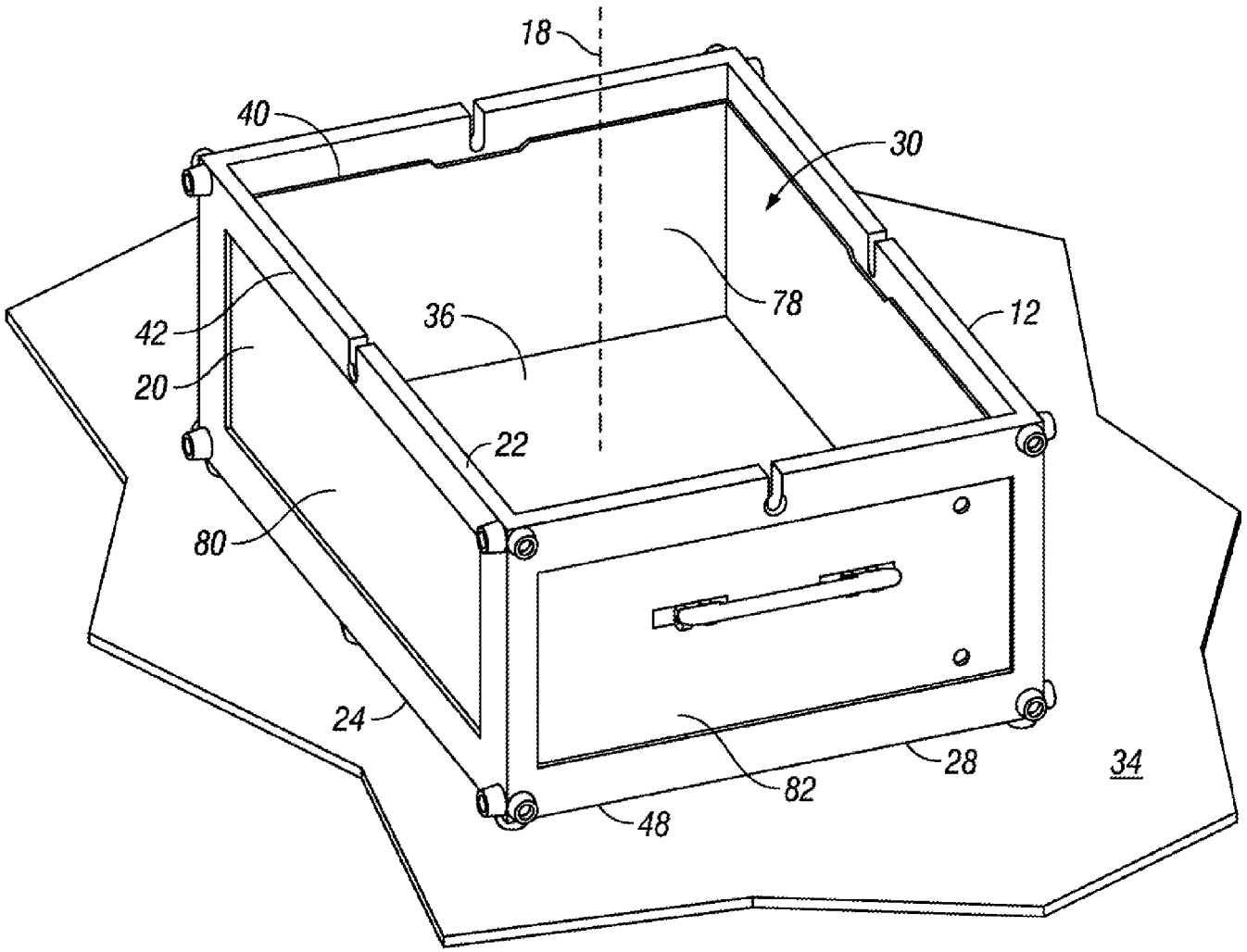
FIG. 2 is a perspective view of the upper portion of the instant test kit, resting in an inverted position.

Turning now to FIG. 2, which depicts an embodiment of top portion 12 inverted and resting on a support surface 34, top side 28 may be attached to continuous sidewall 20 at an inner face of the top side 36, such that top portion 12 comprises a hollow interior cavity 30 bound by inner face of the top side 36, and an inner face of the continuous sidewall 40. In an embodiment, hollow interior cavity 30 is open on a bottom side 42, which in an embodiment, is defined by bottom edge 24. In an embodiment, hollow interior cavity 30 has a cross sectional shape taken perpendicular to central axis 18 of a rectangle, however, the cross-sectional shape taken perpendicular to central axis 18 may include any shape having more than three sides, and is thus not limited to a rectangle. The size and shape of hollow interior cavity 30 is dictated by the shape and size of the plurality of components 32 (shown in FIG. 1), which are to be protectively received within hollow interior cavity 30.

Referring to FIGS. 1 and 2, in an embodiment, bottom portion 14 of protective case 38 comprises a bottom plate 44 dimensioned and arranged to engage at least a portion of continuous sidewall 20 such that when top portion 12 is engaged with bottom portion 14, hollow interior cavity 30 is bound on all sides by inner face of the top side 36, inner face of the continuous sidewall 40, and an inner face of the bottom plate 46. In an embodiment, hollow interior cavity 30 of top portion 12 defines a water-tight enclosure opened on bottom side 42, such that top portion 12, resting on support surface 34, inverted on an outer face of the top side 48, is capable of forming a liquid reservoir.

Figure 3:
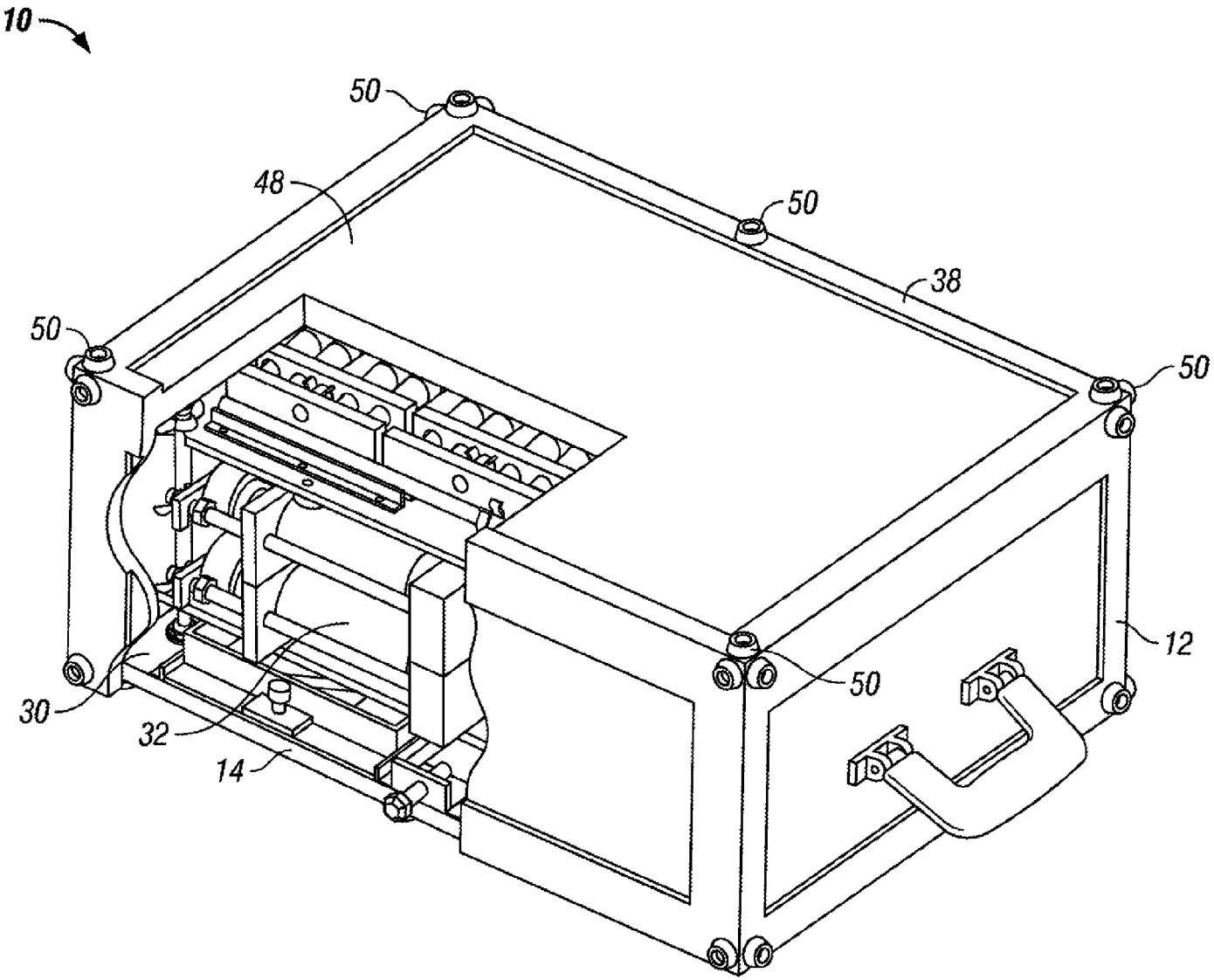
FIG. 3 is a cut away view of the instant test kit in a closed position.

As shown in FIG. 3, test kit 10 comprises protective case 38, which includes top portion 12 engaged with bottom portion 14, such that the plurality of components 32 are protectively received within hollow interior cavity 30.

Figure 4:
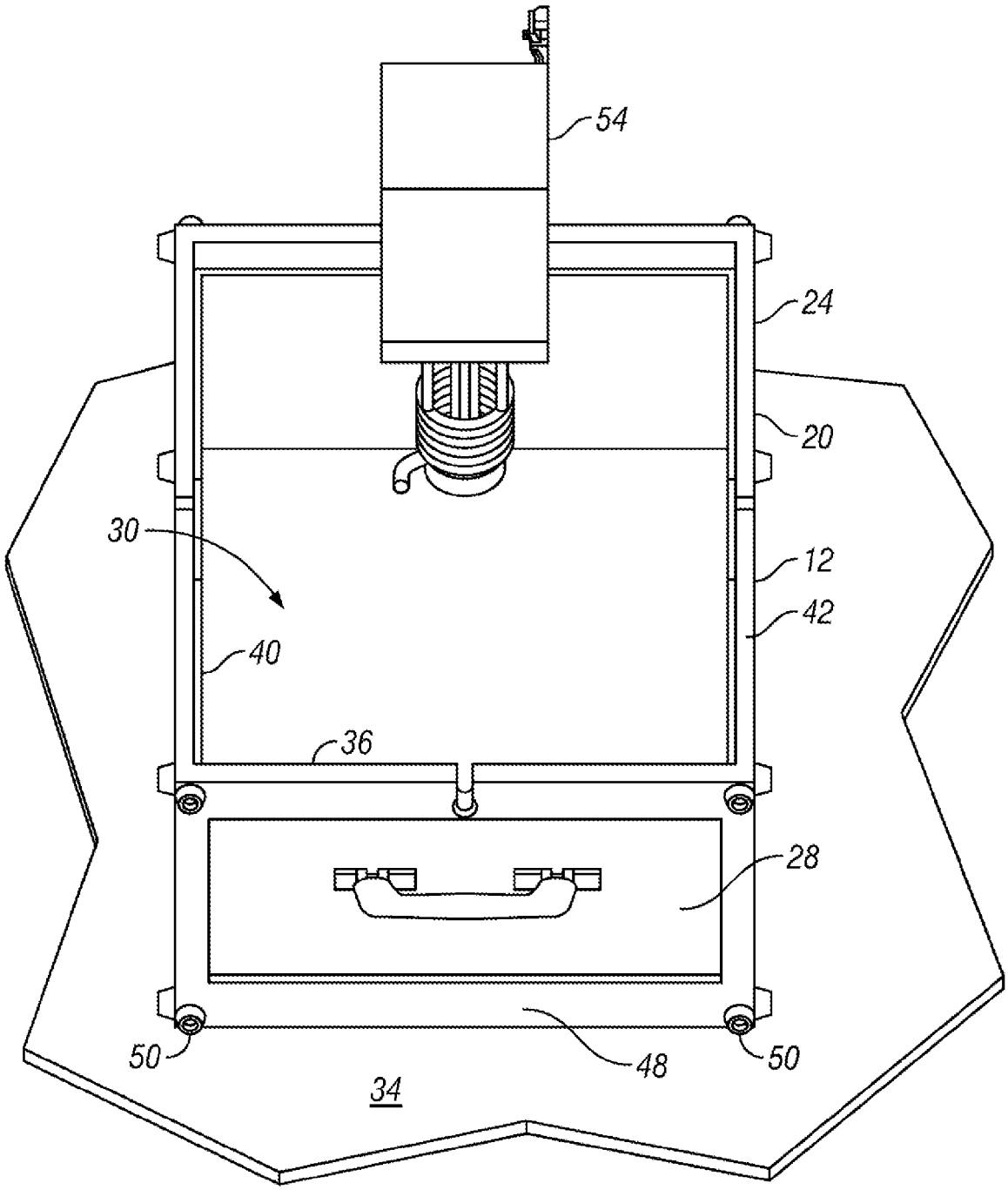
FIG. 4 is a perspective view of the upper portion of the instant test kit being utilized as a water bath.

In an embodiment, legs 50 are provided on outer face of the top side 48, which may position top portion 12 in elevated relation to support surface 34 when top portion 12 is resting on support surface 34 in an inverted position (see FIG. 4.) In an embodiment, telescopingly selectively extendable legs (not shown) may depend away from outer face of the top side 48.

Referring to FIG. 4, in an embodiment, components 32 (see FIG. 1) may include a water bath circulator/temperature controller 54, which is adapted to releasably engage a portion of continuous sidewall 20 when top portion 12 is resting inverted on outer face of the top side 48 on support surface 34 (i.e., when top side 28 is closer to support surface 34 in relation to bottom side 42.) In an embodiment, inner face of the top side 36 and inner face of the continuous sidewall 40 are comprised of fiberglass, stainless steel, or any other material impervious to water such that hollow interior cavity 30 is a water tight reservoir when inverted as shown.

Figure 5A:
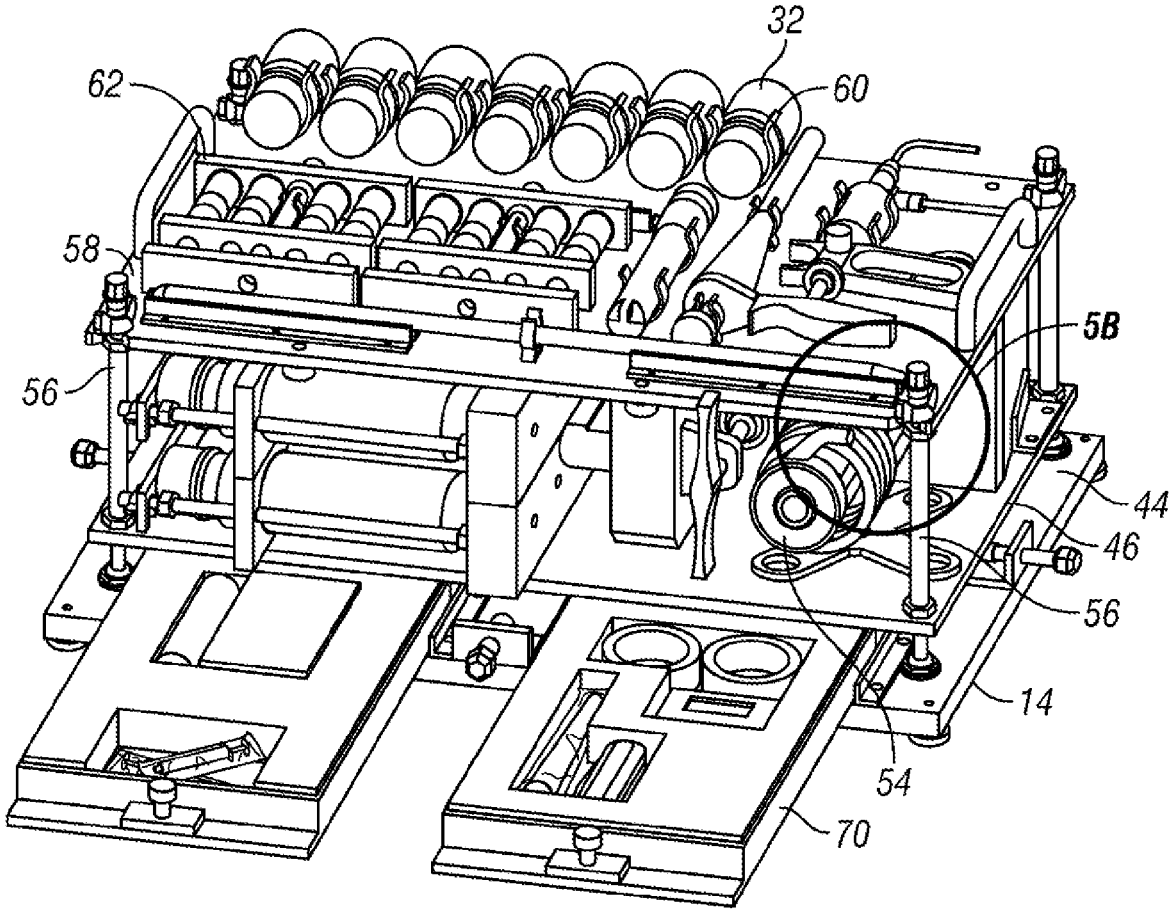
FIG. 5*a* is a perspective view of the bottom portion of the instant test kit.

As shown in FIG. 5*a*, in an embodiment, bottom portion 14 may comprise a plurality of support posts 56, each preferably depending orthogonally away from inner face of the bottom plate 46. In an embodiment, at least one shelf plate 58 is dimensioned and arranged to fit within hollow interior cavity 30 (see FIG. 2.) In an embodiment, shelf plate 58 is releasably attached and/or engaged with at least one of the plurality of support posts 56. In an embodiment, one or more of the plurality of components 32 are releasably attached to at least a portion of shelf plate 58. In an embodiment, at least one of the plurality of components 32 is releasably attached to shelf plate 58 by a spring clip 60, a threaded member 62, a hook and loop fastener, an attachment strap, or any combination of attachment means. Examples include, holder 106, shown in FIG. 8 holding laboratory glassware 72 (e.g., centrifuge tubes), which holder 106 is attachable to shelf plate 58 via threaded member 62.

Figure 5B:
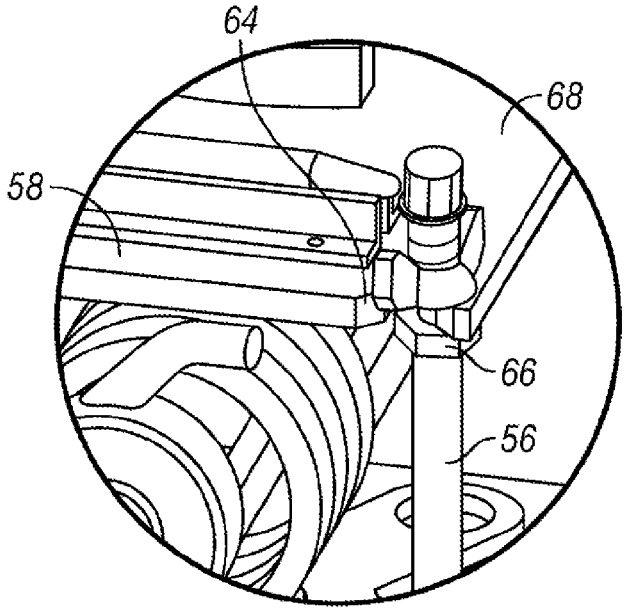
FIG. 5*b* is a magnified view of Detail-A of FIG. 5*a*
Figure 6:
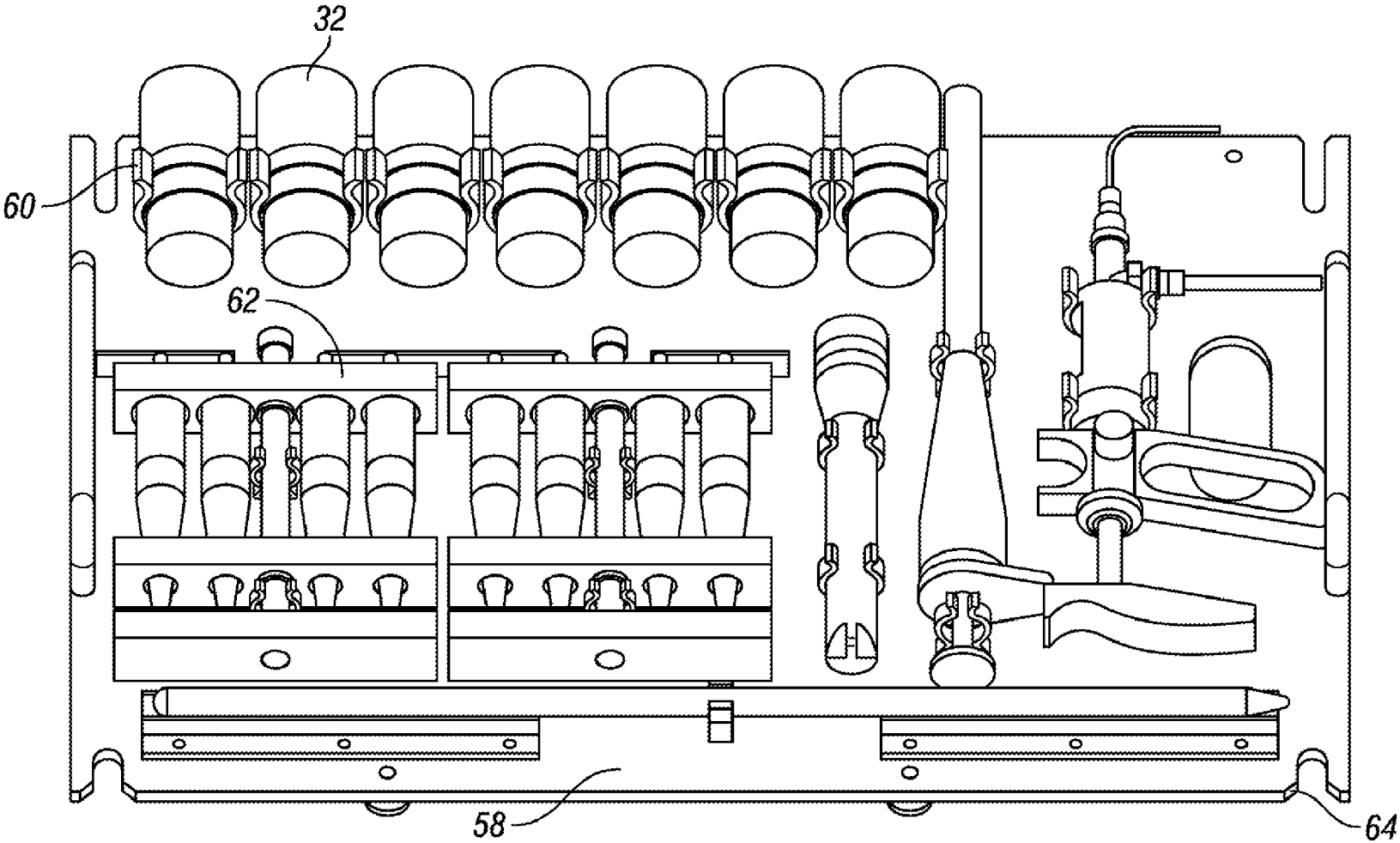
FIG. 6 is a perspective view of a shelf plate of the instant disclosure having components attached thereto.

FIG. 5*b* depicts an enlarged view of Detail A of FIG. 5*a*. As shown in FIG. 5*b*, and FIG. 6, in an embodiment, shelf plate 58 is releasably attached to support post 56 by communication between an attachment indentation 64 disposed along a periphery of the shelf plate 68, attachment indentation 64 being dimensioned and arranged to engage an attachment slot 66 disposed within at least a portion of one of the plurality of support posts 56. As shown in FIG. 5*a*, in an embodiment, bottom portion 14 may include one or more sliding drawers 70, wherein the contents of the drawer are included in the plurality of components 32, and are accessible when top portion 12 (not shown in FIG. 5*a*) is dot engaged with bottom portion 14.

Figure 9:
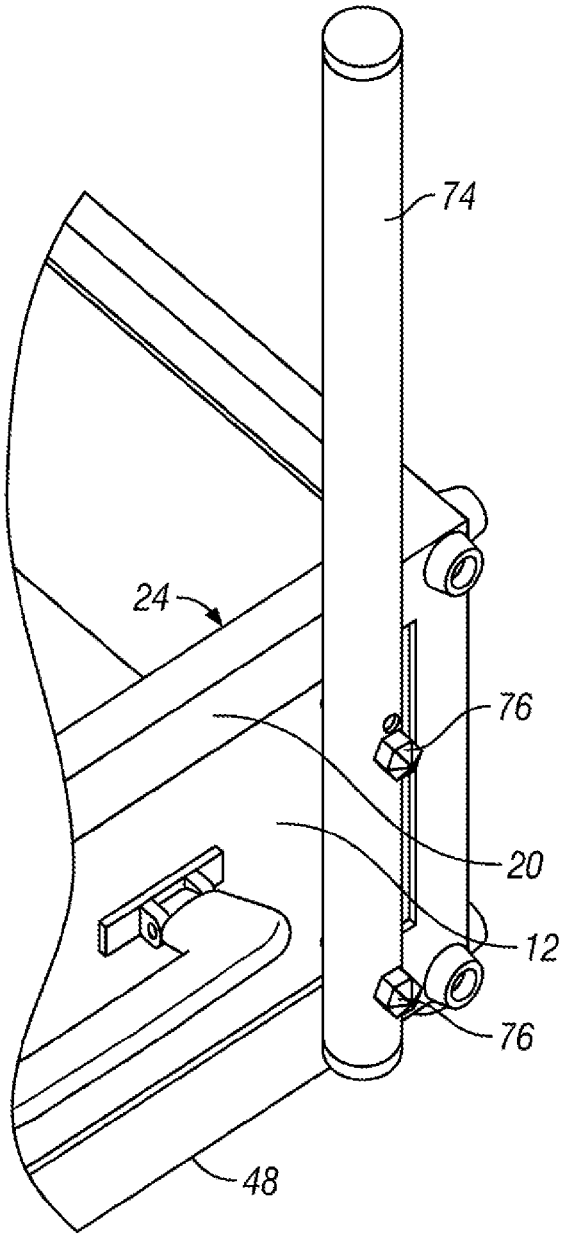
FIG. 9 is a partial view showing the attachment of a support pole to the top portion of the instant disclosure.

In an embodiment, components 32 (see FIG. 1) may include a mechanical stirrer (not shown). As shown in FIG. 9, a mechanical stirrer may include a hollow support rod 74 capable of engaging and supporting a mechanical stirrer, wherein hollow support rod 74 is adapted to releasably engage a portion of continuous sidewall 20 when top portion 12 is resting inverted on outer face of the top side 48 (see FIG. 9.) In an embodiment, hollow support rod 74 is releasably engaged with the portion of continuous sidewall 20 using a spring clip (not shown), an attachment threaded member 76, a clamp (not shown), or a combination of these attachment means. The interior cavity of hollow support rod 74 may further serve as a storage location for various other components including a stir shaft and/or stir turbine.

Figure 10:
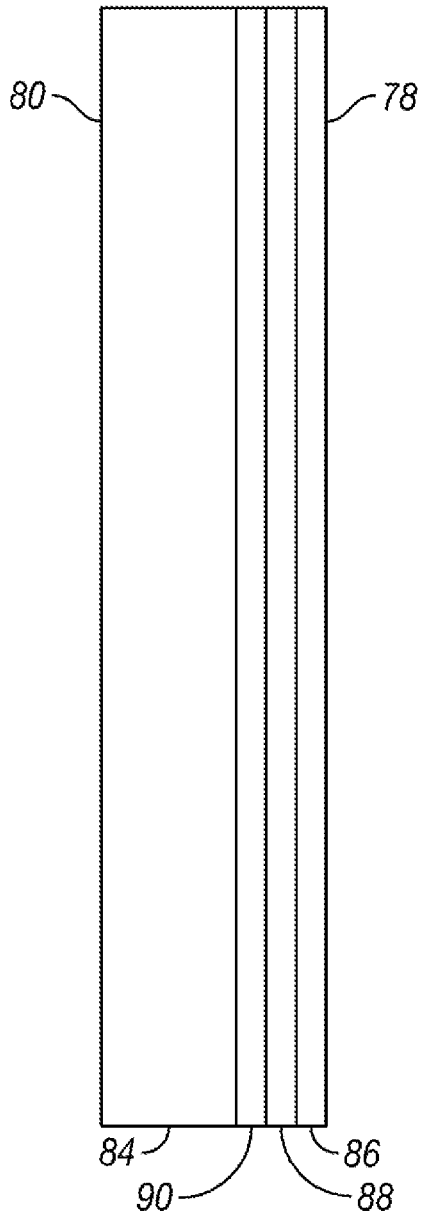
FIG. 10 is a cross sectional view between the top portion inner face and the top portion outer face.

As shown in FIG. 2, top portion 12 has an inner face 78 comprising inner face of the top side 36 and inner face of the continuous sidewall 40. Top portion 12 also has an outer face 80 comprising outer face of the top side 48 and an outer face of the continuous sidewall 82, wherein inner face of the top portion 78 is engaged with outer face of the top portion 80 along a periphery of top portion 12, preferably bottom edge 24. As shown in FIG. 10, in an embodiment, inner face of the top portion 78 is separated from outer face of the top portion 80 by one or more of a layer of insulation 84, a liquid barrier 86, a shock abating material 88, a rigid foam 90, or a combination thereof, disposed between inner face of the top portion 78 and outer face of the top portion 80.

In an embodiment, outer face of the top portion 80 (see FIG. 1), outer face of the bottom portion 92, or a combination thereof, comprise one or more retractable rollers (not shown), handles 94, elastic bumpers 96, or a combination thereof.

In an embodiment, top portion 12 is releasably attached to bottom portion 14 via one or more of a releasable latch (not shown), an attachment belt (not shown), a releasable attachment threaded member 98 (see FIG. 1), a dowel pin (not shown), or a combination thereof. In an embodiment, top portion 12 is releasably engaged with the bottom portion 14 via one or more releasable attachment threaded members 98, each releasable attachment threaded member 98 arranged in communication with bottom portion 14 such that releasable attachment threaded member 98 protrudes laterally from a periphery of bottom portion 14; releasable attachment threaded member 98 being dimensioned and arranged to protrude through an attachment opening 100 disposed within a portion of continuous sidewall 20, wherein a head of the releasable attachment threaded member 102 frictionally engages a portion of outer face of the continuous sidewall 82 and/or wherein a nut engaged with releasable attachment threaded member 98 frictionally engages a portion of the outer face of the continuous sidewall 82.

In an embodiment, a deformable sealing member 104 is disposed between bottom edge 24 of continuous sidewall 20 and inner face of the bottom plate 46, and/or deformable sealing member 104 is disposed between inner face of the continuous sidewall 40 and a peripheral edge of the bottom plate 44 such that top portion 12 is sealingly engagable with bottom portion 14 (see FIG. 2). Deformable sealing member 104 may include a rubber gasket, an O-ring, and/or any deformable material suitable for use as a gasket. Deformable sealing member 104 may be disposed within a groove and/or slot (not shown), which may be disposed in the top portion, the bottom portion, or a combination thereof. In an embodiment, bottom portion 14 sealingly engages top portion 12, such that when bottom portion 14 is engaged with top portion 12, the hollow interior cavity 30 is not in fluid communication with the external environment.

In an embodiment, the plurality of components of the instant test kit may include chemical additives, chemical reagents, and/or laboratory components useful in the testing of exploration and production waste from an oil and/or gas well. In particular, the plurality of components may include demulsifiers, surfactants, control standards, and the like, necessary to evaluate the composition and determine a treatment regime to reclaim E&P waste. In an embodiment, the plurality of components includes the equipment and supplies required to conduct ASTM. Methods D4007, e.g., ASTM D4007-02 (2006) Standard Test Method for Water and Sediment in Crude Oil by the Centrifuge Method, or an equivalent thereof.

Figure 7:
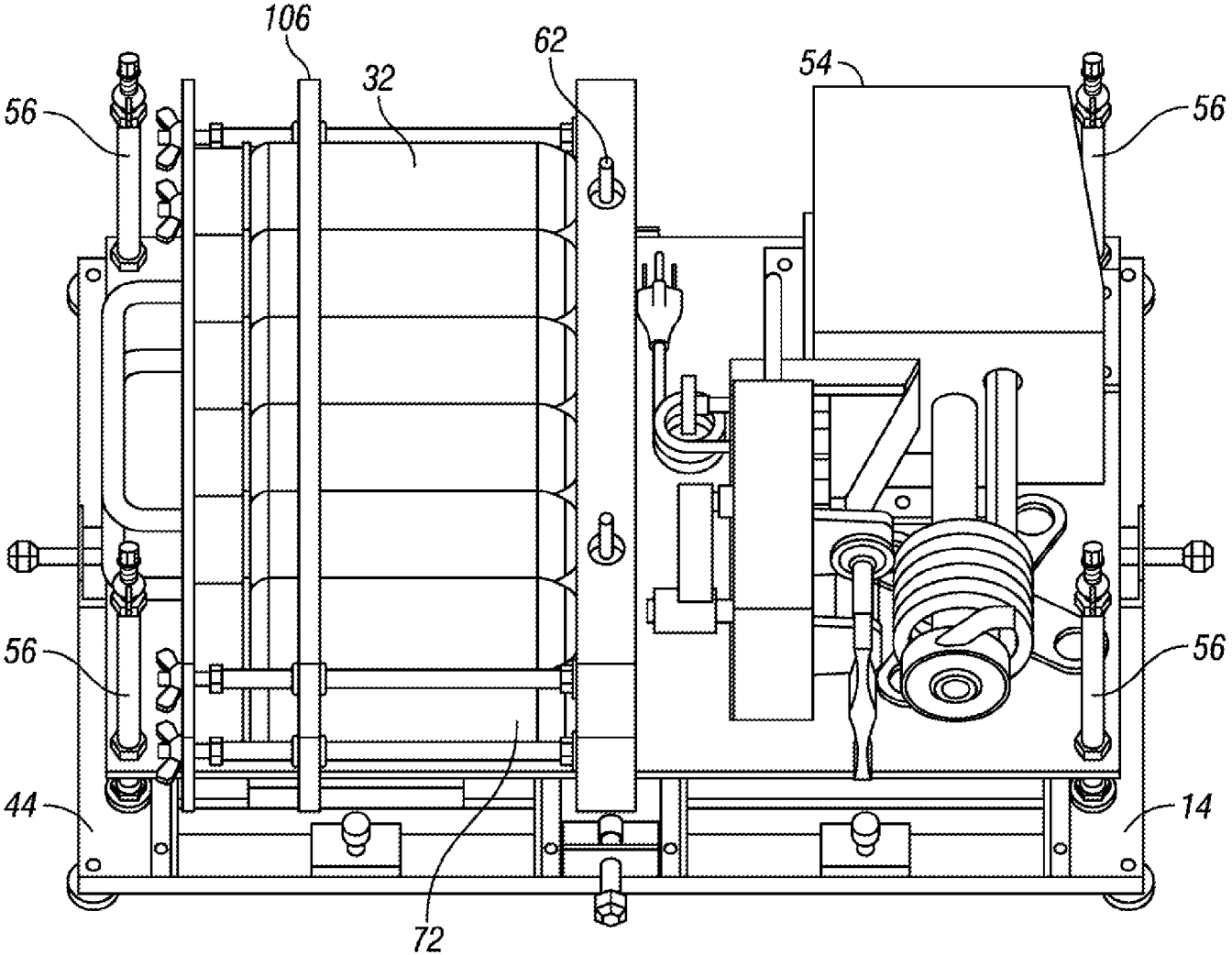
FIG. 7 is a perspective view of the bottom plate of the instant disclosure having components attached thereto.
Figure 8:
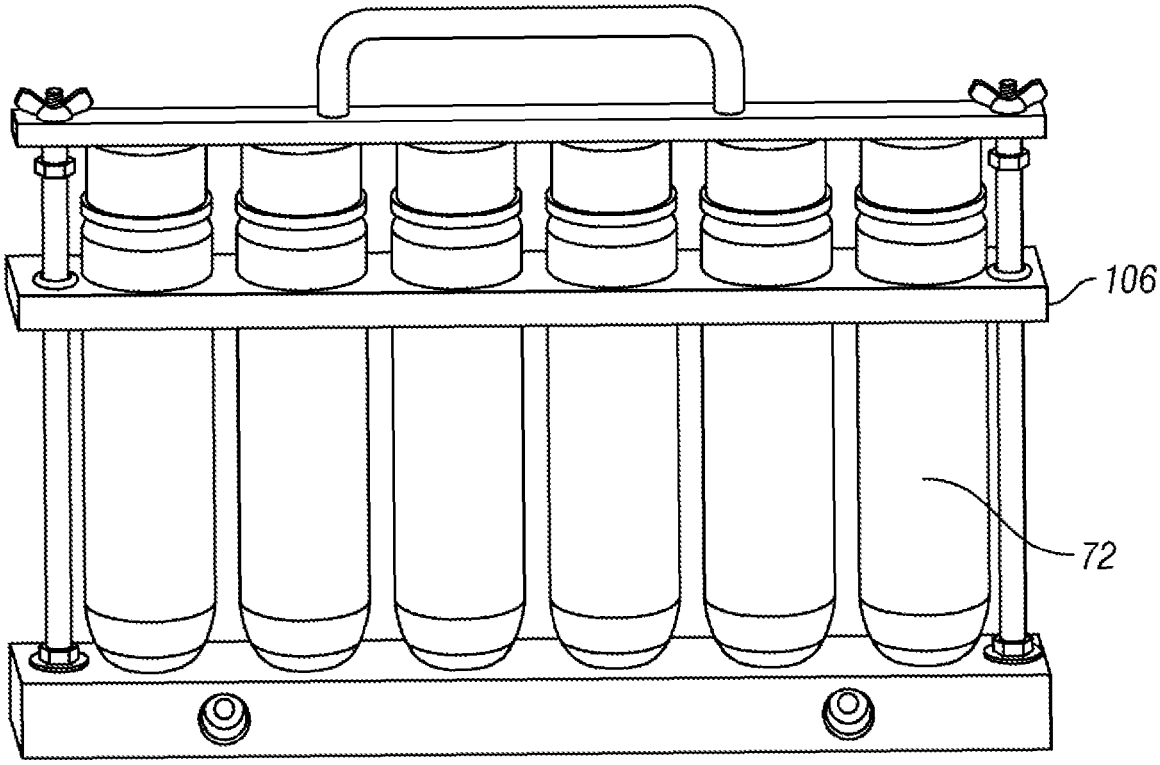
FIG. 8 is a frontal view of a holder of the instant disclosure.

In an embodiment, the plurality of components include laboratory glassware components e.g., centrifuge tubes, beakers, mixing equipment, flasks, and the like. In an embodiment, the components are received protectively within the hollow interior cavity and secured therein such that the test kit may be shipped via a commercial courier (e.g., Federal Express, the U.S. Mail, and/or the United Parcel Service) without the laboratory glassware components being broken during transit. As such, the instant test kit may be shipped to remote locations and effectively utilized for testing of E&P waste. As shown in FIG. 8, laboratory glassware 72 (e.g., centrifuge tubes) may be secured in holders 106, which may be dimensioned and arranged to be secured to one or more shelf plates 56 (see FIG. 7.) In addition, the holder 106 shown in FIG. 8, which is shown to include graduated gravity separation tubes, may be dimensioned and arranged to be lifted in and out of the water bath using a handle integral to holder 106. The top portion of holder 106; to which the handle is attached, may further be detachable by a side notch such that it swings out so that a person may access the lids to the separation tubes and take them on and off. The bottom surface of the top portion, which touches the lids, may further be padded with deformable material so that crunching of the glassware is avoided. The bottom of holder 106 is preferably constructed of heavy material which prevents the racks tipping over in the water bath.

In another embodiment, the instant test kit may include laboratory glassware components, wherein the plurality of components are received protectively within the hollow interior cavity and secured therein such that the test kit may be dropped onto a hard surface from a normal carrying height (e.g., the distance between the ground and the bottom of the instant test kit while the test kit is being carried by a person of average height), without the laboratory glassware components being broken. This facet of the invention may be furthered by appropriate selection of robust clips, racks, latches, and/or other types of holders specific to each individual piece of equipment.

It should be understood, of course, that the foregoing relates to preferred embodiments of the invention and that modifications may be made without departing from the spirit and scope of the invention as set forth in the following claims.

What is claimed:

1. A test kit for testing production waste comprising:

a plurality of components comprising reagents, test equipment, or a combination thereof, sufficient to perform analysis on production waste;

at least one protective case for shipping and for using the plurality of components, the protective case comprising a top portion releasably engaged with a bottom portion;

the top portion comprising a top side attached at an inner face of the top side to a top edge of a continuous sidewall formed by a plurality of sides such that the top portion of the protective case comprises a hollow interior cavity bound by the inner face of the top side and an inner face of the continuous sidewall, wherein the hollow interior cavity is open on a bottom side, and wherein the hollow interior cavity defines a water-tight enclosure opened on the bottom side, such that the top portion, resting on a support surface inverted on an outer face of the top side, is capable of forming a liquid reservoir, wherein the bottom portion comprises a bottom plate dimensioned and arranged to releasably engage at least a portion of the continuous sidewall, and a plurality of support posts, each depending orthogonally away from the inner face of the bottom plate, and at least one shelf plate dimensioned and arranged to fit with the hollow interior cavity, wherein the shelf plate is releasably attached to at least one of the plurality of support posts, and wherein one or more of the plurality of components are releasably attached to at least a portion of the shelf plate; and wherein the plurality of components include chemical additives, chemical reagents, and/or laboratory components useful in the testing of exploration and production waste from an oil and/or gas well.

2. The test kit of claim 1, wherein legs are provided on the outer face of the top side to position the top portion in elevated relation to the support surface.

3. The test kit of claim 2, wherein the legs are telescopically selectively extendible legs.

4. The test kit of claim 1, wherein the plurality of components includes a water bath circulator/temperature controller adapted to releasably engage a portion of the continuous sidewall when the top portion is resting inverted on the outer face of the top side.

5. The test kit of claim 1, wherein at least one of the plurality of components is releasably attached to the shelf plate by a spring clip, a threaded member, a hook and loop fastener, an attachment strap, or a combination thereof.

6. The test kit of claim 1, wherein the shelf plate comprises an attachment indentation along a periphery of the shelf plate dimensioned and arranged to engage an attachment slot disposed within at least a portion of one of the plurality of support posts.

7. The test kit of claim 1, wherein one or more of the shelf plates comprise a sliding drawer, wherein the contents of the drawer are accessible when the top portion is not engaged with the bottom portion.

8. The test kit of claim 1, wherein the plurality of components includes a mechanical stirrer comprising a hollow support rod, wherein the hollow support rod is adapted to releasably engage a portion of the continuous sidewall when the top portion is resting inverted on the outer face of the top side.

9. The test kit of claim 8, wherein the hollow support rod is releasably engaged with the portion of the continuous sidewall using a spring clip, an attachment threaded member, a clamp, or a combination thereof.

10. The test kit of claim 1, wherein the plurality of components include laboratory glassware components, and wherein the plurality of components are received protectively within the hollow interior cavity and secured therein such that the test kit may be shipped via a commercial courier without the laboratory glassware components being broken.

11. The test kit of claim 1, wherein the plurality of components include laboratory glassware components, and wherein the plurality of components are received protectively within the hollow interior cavity and secured therein such that the test kit may be dropped onto a hard surface from a normal carrying height without the laboratory glassware components being broken.

12. The test kit of claim 1, wherein the inner face of the top side and the inner face of the continuous sidewall are comprised of fiberglass, stainless steel, or a combination thereof.

13. The test kit of claim 1, wherein the top portion has an inner face comprising the inner face of the top side and the inner face of the continuous sidewall, and wherein the top portion has an outer face comprising the outer face of the top side and an outer face of the continuous sidewall, wherein the inner face of the top portion is engaged with the outer face of the top portion along a periphery of the top portion, and wherein the inner face of the top portion is separated from the outer face of the top portion by one or more of a layer of insulation, a liquid barrier, a shock abating material, a rigid foam, or a combination thereof.

14. The test kit of claim 13, wherein the outer face of the top portion, the outer face of the bottom portion, or a combination thereof, comprise one or more retractable rollers, handles, elastic bumpers, or a combination thereof.

15. The test kit of claim 1, wherein the top portion is releasably attached to the bottom portion via one or more of a releasable latch, an attachment belt, a releasable attachment threaded member, a dowel pin, or a combination thereof.

16. The test kit of claim 1, wherein the top portion is releasably engaged with the bottom portion via one or more releasable attachment threaded members, each releasable attachment threaded member arranged in communication with the bottom portion such that the releasable attachment threaded member protrudes laterally from a periphery of the bottom portion, the releasable attachment threaded member dimensioned and arranged to protrude through an opening disposed within a portion of the continuous sidewall, wherein a head of the releasable attachment threaded member frictionally engages a portion of an outer face of the continuous sidewall and/or wherein a nut engaged with the releasable attachment threaded member frictionally engages a portion of the outer face of the continuous sidewall.

17. The test kit of claim 16, wherein the bottom portion comprises a bottom plate dimensioned and arranged to releasably engage at least a portion of the continuous sidewall, and wherein a deformable sealing member is disposed between a bottom edge of the continuous sidewall and the inner face of the bottom plate, wherein a deformable sealing member is disposed between the inner face of the continuous sidewall and a peripheral edge of the bottom plate, or a combination thereof.

18. The test kit of claim 1, wherein the bottom portion sealingly engages the top portion such that when the bottom portion is engaged with the top portion, the hollow interior cavity is not in fluid communication with the external environment.

* * * * *